US007257846B2

(12) United States Patent
Paciorkowski

(10) Patent No.: US 7,257,846 B2
(45) **Date of Patent: *Aug. 21, 2007**

(54) PROTECTIVE GARMENT FOR USE IN SPORTING GAMES

(75) Inventor: Tracy James Paciorkowski, Bayonne, NJ (US)

(73) Assignee: Field Armor, Inc., New York, NY (US)

( * ) Notice: Subject to any disclaimer, the term of this patent is extended or adjusted under 35 U.S.C. 154(b) by 162 days.

This patent is subject to a terminal disclaimer.

(21) Appl. No.: 10/858,036

(22) Filed: Jun. 1, 2004

(65) Prior Publication Data

US 2004/0216213 A1 Nov. 4, 2004

Related U.S. Application Data

(63) Continuation-in-part of application No. 10/419,344, filed on Apr. 21, 2003, now Pat. No. 6,745,400.

(51) Int. Cl.
*A41D 27/26* (2006.01)

(52) U.S. Cl. ..... 2/267; 2/69

(58) Field of Classification Search ..... 2/227, 2/228, 2.5, 22, 463, 69, 910, 23, 238, 455, 2/102, 457, 79, 115, 267
See application file for complete search history.

(56) References Cited

U.S. PATENT DOCUMENTS

| | | | | |
|---|---|---|---|---|
| 759,833 | A | 5/1904 | Stall | |
| 1,489,784 | A | 4/1924 | O'Shea | |
| 4,453,271 | A * | 6/1984 | Donzis | 2/456 |
| 4,507,801 | A | 4/1985 | Kavanagh et al. | |
| 4,608,716 | A | 9/1986 | Brumfield | 2/2.5 |
| 4,637,075 | A | 1/1987 | Ingrisano et al. | 2/94 |
| 4,639,944 | A * | 2/1987 | Lashley et al. | 2/456 |
| 4,669,125 | A | 6/1987 | Allen | 2/2 |
| 4,722,099 | A | 2/1988 | Kratz | 2/79 |
| 5,052,052 | A | 10/1991 | Gilford et al. | 2/2 |
| 5,105,478 | A | 4/1992 | Pyc | 2/115 |
| 5,159,718 | A | 11/1992 | Moyer | 2/69 |
| 5,337,418 | A | 8/1994 | Kato et al. | 2/2 |
| 5,675,838 | A | 10/1997 | Hollinger | 2/69 |
| 5,729,832 | A * | 3/1998 | Grilliot et al. | 2/23 |
| 5,742,939 | A | 4/1998 | Williams | 2/69 |

(Continued)

FOREIGN PATENT DOCUMENTS

CH 638665 10/1983

OTHER PUBLICATIONS

U.S. Appl. No. 60/396,328, Universal Earth Suit, George L. Matthews, filed Jul. 10, 2002.*

*Primary Examiner*—Alissa Hoey
(74) *Attorney, Agent, or Firm*—Michael L. Leetzow, P.A.

(57) ABSTRACT

A protective garment is disclosed that is used in sporting games to protect the wearer from projectiles fired by the other participants. The garment may be of a unitary construction or have a plurality of components. Additionally, the garment may only cover selected portions of the wearer's body, to protect those areas needing protection. The padding used to protect the wearer may be removed or enhanced by the wearer before, during, and after the games. The garment also includes a number of vents to allow body heat to escape and securing elements to minimize the risk of the garment catching on bush and brush.

18 Claims, 10 Drawing Sheets

U.S. PATENT DOCUMENTS

| | | | | |
|---|---|---|---|---|
| 5,781,935 | A * | 7/1998 | Bassett et al. | 2/455 |
| 6,038,701 | A | 3/2000 | Regan | 2/125 |
| 6,041,436 | A | 3/2000 | Keen | 2/69 |
| 6,260,196 | B1 | 7/2001 | Van der Sleesen | 2/2.5 |
| 6,289,524 | B1 * | 9/2001 | Wright et al. | 2/455 |
| 6,332,221 | B1 | 12/2001 | Gracey | 2/69 |
| 6,353,932 | B2 | 3/2002 | Stembridge | 2/69 |
| 6,357,054 | B1 | 3/2002 | Bainbridge et al. | 2/455 |
| 6,477,711 | B1 * | 11/2002 | Freeman et al. | 2/69 |
| 6,510,560 | B1 * | 1/2003 | Ugolnik | 2/455 |
| 6,745,400 | B1 * | 6/2004 | Paciorkowski | 2/69 |
| 6,941,584 | B1 * | 9/2005 | Matthews | 2/234 |
| 2001/0029621 | A1 * | 10/2001 | Howland et al. | 2/2.5 |

* cited by examiner

PROTECTIVE GARMENT FOR USE IN SPORTING GAMES

The present application is a continuation-in-part of pending application Ser. No. 10/419,344, filed on Apr. 21, 2003, to be U.S. Pat. No. 6,745,400.

The present invention relates to a protective garment to protect a wearer during sporting games, and more particularly, a protective garment that has padding in a plurality of locations to reduce the impact of projectiles fired at the wearer during the sporting games.

There are a number of prior art garments that have padding or cover certain portions of the body. However, none of these garments are intended for or appropriate for the sporting games. This is particularly true when high speed projectiles are launched at the wearer of the garments. Additionally, many of the garments are made for other sporting activities, such as coveralls for hunting, skating, football, karate, and hockey, where the concerns are different than from the present sporting games.

Accordingly, the present invention is directed to a protective garment that substantially obviates one or more of the problems and disadvantages in the prior art. Additional features and advantages of the invention will be set forth in the description that follows, and in part will be apparent from the description, or may be learned by practice of the invention. The objectives and other advantages of the invention will be realized and attained by the apparatus and process particularly pointed out in the written description and claims, as well as the appended drawings.

SUMMARY OF THE INVENTION

To achieve these and other advantages and in accordance with the purpose of the invention as embodied and broadly described herein, the invention is directed to a protective garment for use in sporting games, the protective garment includes an upper portion for covering at least a portion of a wearer's arms and torso, a lower portion for covering at least a portion of the wearer's waist area and legs, a plurality of pads on the protective garment to protect the wearer during the sporting games, and a plurality of securing members to secure the protective garment at a plurality of locations on the wearer.

In yet another aspect, the invention is directed to a protective garment for use in sporting games, the protective garment includes an upper portion for covering at least a portion of a wearer's arms and torso, a lower portion for covering at least a portion of the wearer's waist area and legs, the lower portion being separate from the upper portion, a plurality of pads on the upper and lower portions of the protective garment to protect the wearer during the sporting games, and a plurality of securing members to secure the protective garment at a plurality of locations on the wearer.

It is to be understood that the foregoing general description and the following detailed description are exemplary and explanatory and are intended to provide further explanation of the invention as claimed.

The accompanying drawings are included to provide a further understanding of the invention and are incorporated in and constitute a part of the specification. The drawings illustrate several embodiments of the invention and together with the description serve to explain the principles of the invention.

DETAILED DESCRIPTION OF THE INVENTION

Figure 1:
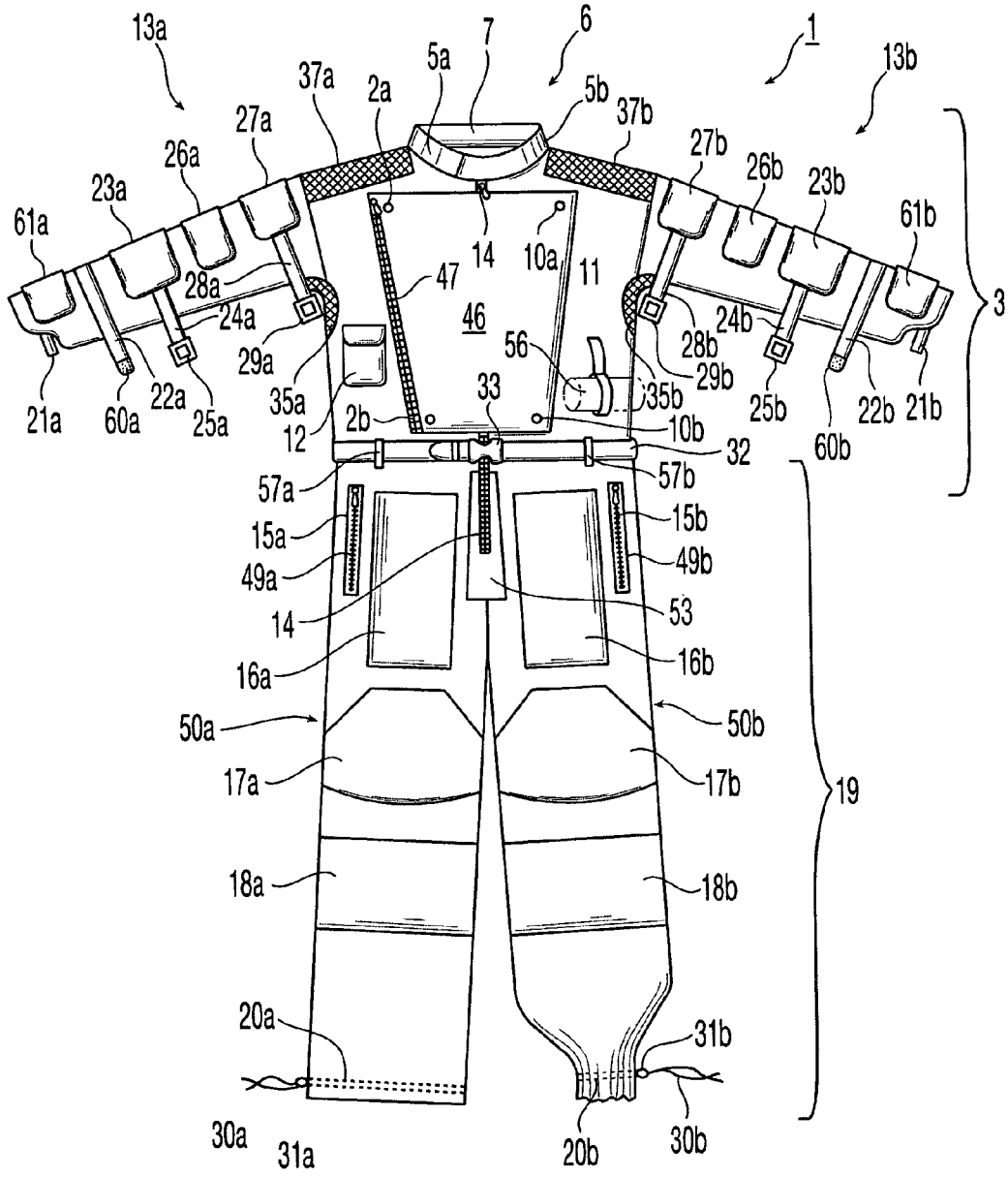
FIG. 1 is a front view of one embodiment of a protective garment according to the present invention.

FIG. 1 is a front view of one embodiment of a protective garment 1, showing closed central body zipper 14 laterally connecting the upper and lower torso portions, 3 and 19, respectively. Waist belt 32 is shown with buckle 33 closed, with female buckle portion 4 and male waist buckle portion 34 (shown in FIG. 2), attached to create a snug fit for the player. This snug fit safely prevents the garment from accidentally catching onto obstacles during game play. A pair of front belt loops 57*a* and 57*b* (shown in FIG. 1) and back belt cover 58 (shown in FIG. 2) also assist in snugly affixing the belt 32 to the garment 1.

Figure 2:
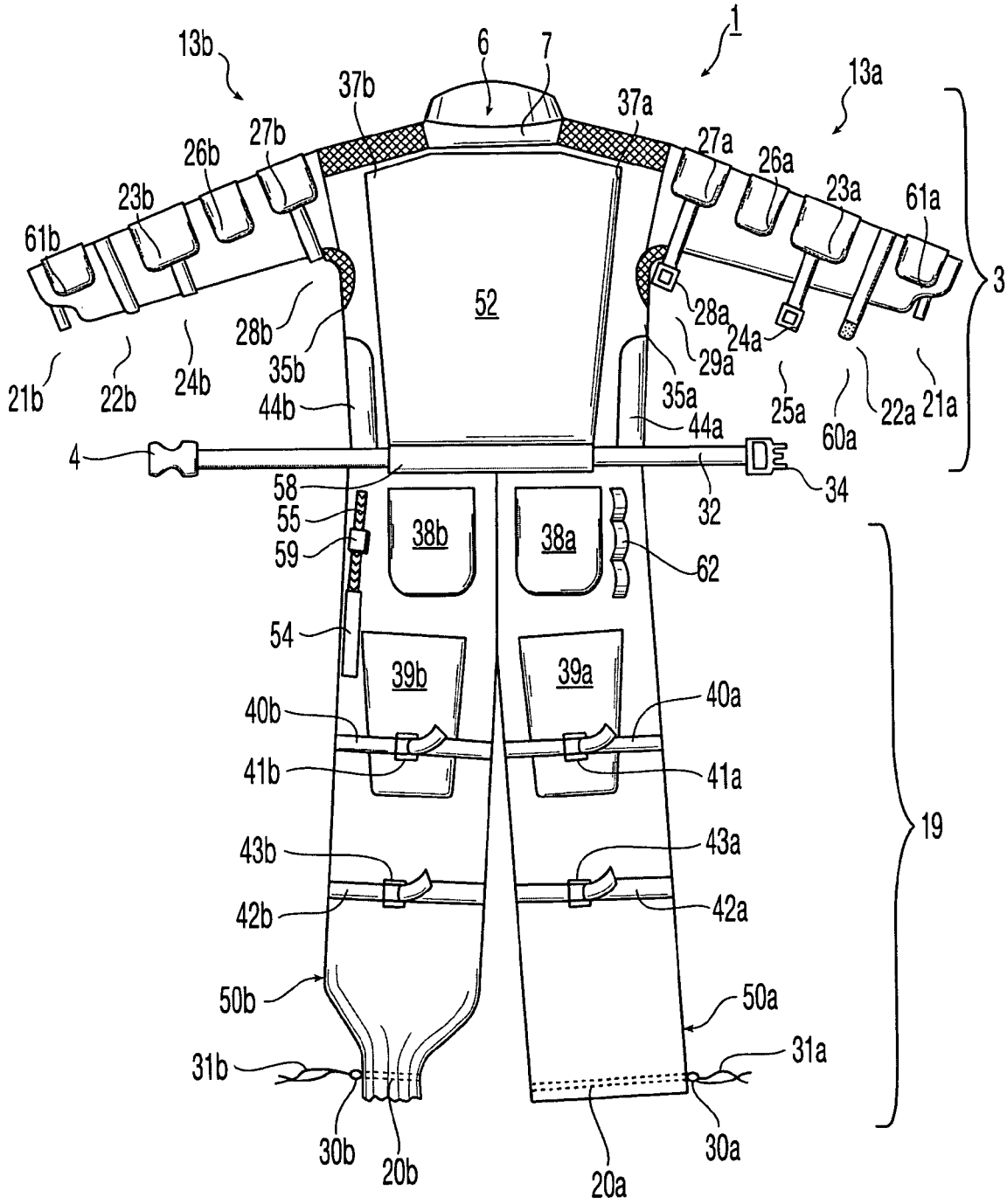
FIG. 2 is a rear view of the protective garment of FIG. 1.

As shown in FIGS. 1 and 2, protective safety padding of varying sizes and shapes give extra protection to vulnerable areas of the player's body. This padding is preferably made of neoprene (or similar) material and is preferably one quarter (¼) of an inch in thickness. From the upper torso 3 through the lower torso 19, this padding preferably includes: padded collar back 7, chest bib 46, back padding 52, pair of shoulder padding 37*a* and 37*b*, pair of elbow padding 26*a* and 26*b*, pair of biceps padding 27*a* and 27*b*, pair of forearm padding 23*a* and 23*b*, pair of wrist padding 61*a* and 61*b*, pair of kidney padding 44*a* and 44*b*, crotch padding 53, pair of seat padding 38*a* and 38*b*, pair of thigh padding 16*a* and 16*b*, pair of back thigh padding 39*a* and 39*b*, pair of knee padding 17*a* and 17*b*, and pair of shin padding 18*a* and 18*b*. This protective safety padding can also be quilted in an aesthetic design for decoration which also helps strengthen the material. As shown in FIGS. 1 and 2, the pair of shoulder padding 37*a* and 37*b* have a quilted design feature.

As shown in FIGS. 1 and 2, a snug fit of sleeves 13*a* and 13*b* is created by adjusting a pair of cuff straps 21*a* and 21*b*, which are preferably elastic, a pair of wrist straps 22*a* and 22*b* with pair of closures 60*a* and 60*b* that are preferably hook-and-loop type materials, pair of elbow straps 24*a* and 24*b* with pair of closures 25*a* and 25*b* that are preferably safety closures, and pair of bicep straps 28*a* and 28*b* with pair of closures 29*a* and 29*b* that are preferably safety closures. For pant legs 50*a* and 50*b*, these include: a pair of knee straps 40*a* and 40*b* with pair of closures 41*a* and 41*b* that are preferably safety closures, and pair of shin straps 42*a* and 42*b* with pair of closures 43*a* and 43*b* that are also preferably safety closures.

Figure 3:
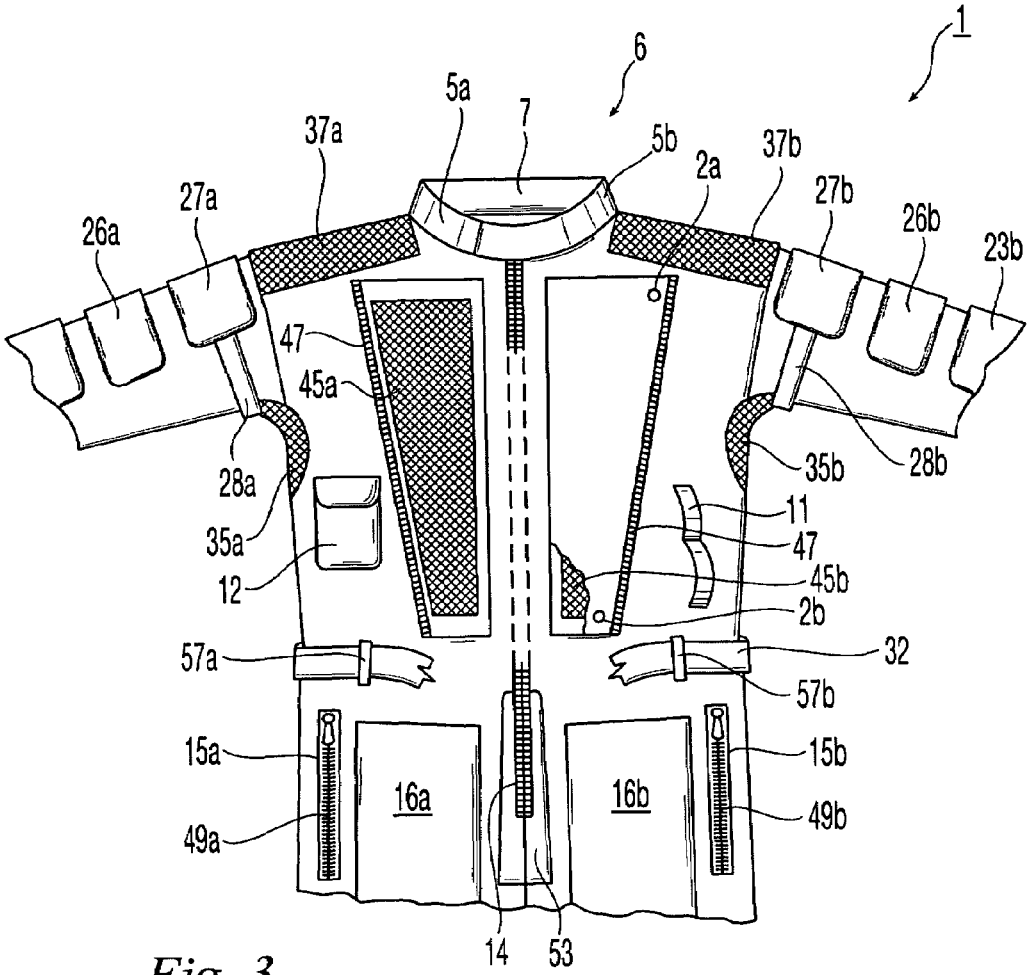
FIG. 3 is a partial view of the front of the protective garment of FIG. 1 with the bib in an open configuration.

As shown in FIG. 1 and in detail in FIG. 3, another safety feature of the protective garment 1 is that padded chest bib zipper 47 can be unzipped and open chest bib 46 can be folded over and attached to its opposite side with females snaps 2*a* and 2*b* snapping into males snaps 10*a* and 10*b*, exposing a pair of mesh chest side panels 45*a* and 45*b* which ventilate the player to ensure that the player does not become overheated.

As shown in FIGS. 1, 2, and 3, a pair of mesh underarm panels 35*a* and 35*b* also ventilate the player to ensure the player will not become overheated.

Figure 4:
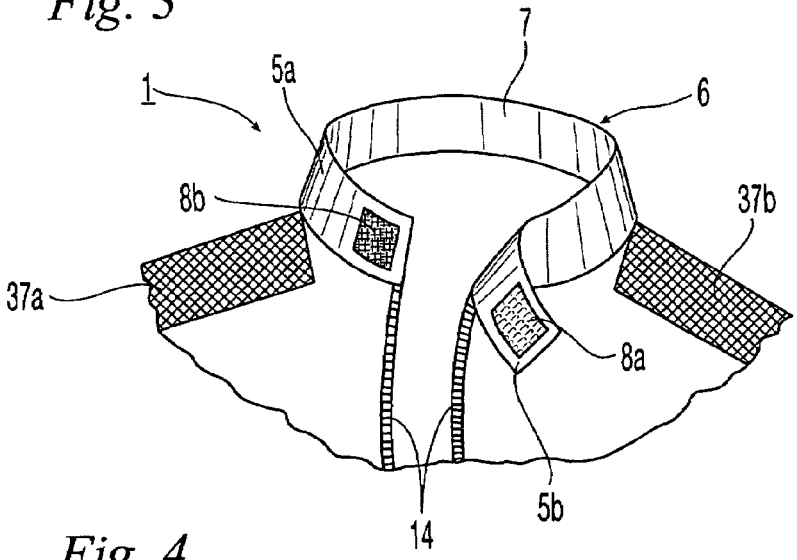
FIG. 4 is a partial front view of the collar of the protective garment in FIG. 1 in an open configuration.

As shown in FIGS. 1 and 2, and in detail in FIG. 4, collar 6 is shown in the open position, with pair of front collar tabs 5*a* and 5*b* attached by pair of hook-and-loop closures 8*a* and 8*b* to ensure a snug fit so as not to allow projectiles or any loose debris to hit the player's neck. The hook-and-loop closures 8*a* and 8*b* also allow for the collar to open if caught on any branches or other obstacles in order not to choke the player.

As shown in FIGS. 1 and 2, another safety feature includes a pair of ankle drawstrings 31*a* and 31*b* pulled closed at pair of stopper closures 30*a* and 30*b* through tunnel stitching 20*a* and 20*b*, in order to adjust the length of the pair of pant legs 50*a* and 50*b* to the player's height, in order for the player avoid tripping during play.

As also shown in FIGS. 1 and 2, accessory holders are also built into the device to safely store the accessories to avoid accidental dropping or explosion during play which would cause the player to trip up or be injured. These include: front holder 11 (preferably elastic), for paintball marker canister 56 (shown in phantom), with a plurality of compartments (preferably holding two canisters), and rear paintball marker canister holder 62 (preferably elastic), with a plurality of compartments (preferably holding three canisters), and squeegee pocket 54 and loop 59 for holding a squeegee 55. A pair of side hip pockets 15*a* and 15*b* (with pair of zipper closures 49*a* and 49*b* shown in the closed position), and front side rib flap pocket 12 to hold small objects.

Figure 5:
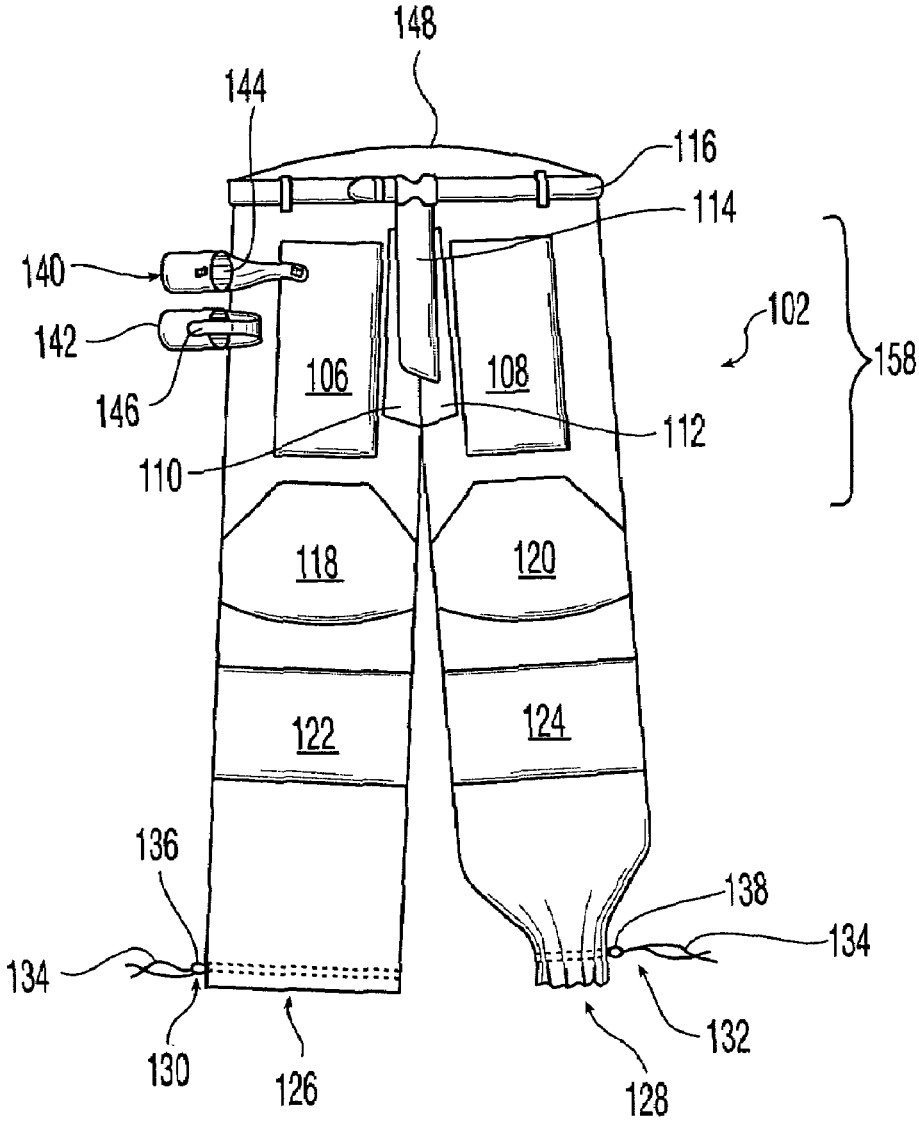
FIG. 5 is a front view of a second embodiment of a lower portion of a protective garment according to the present invention.
Figure 6:
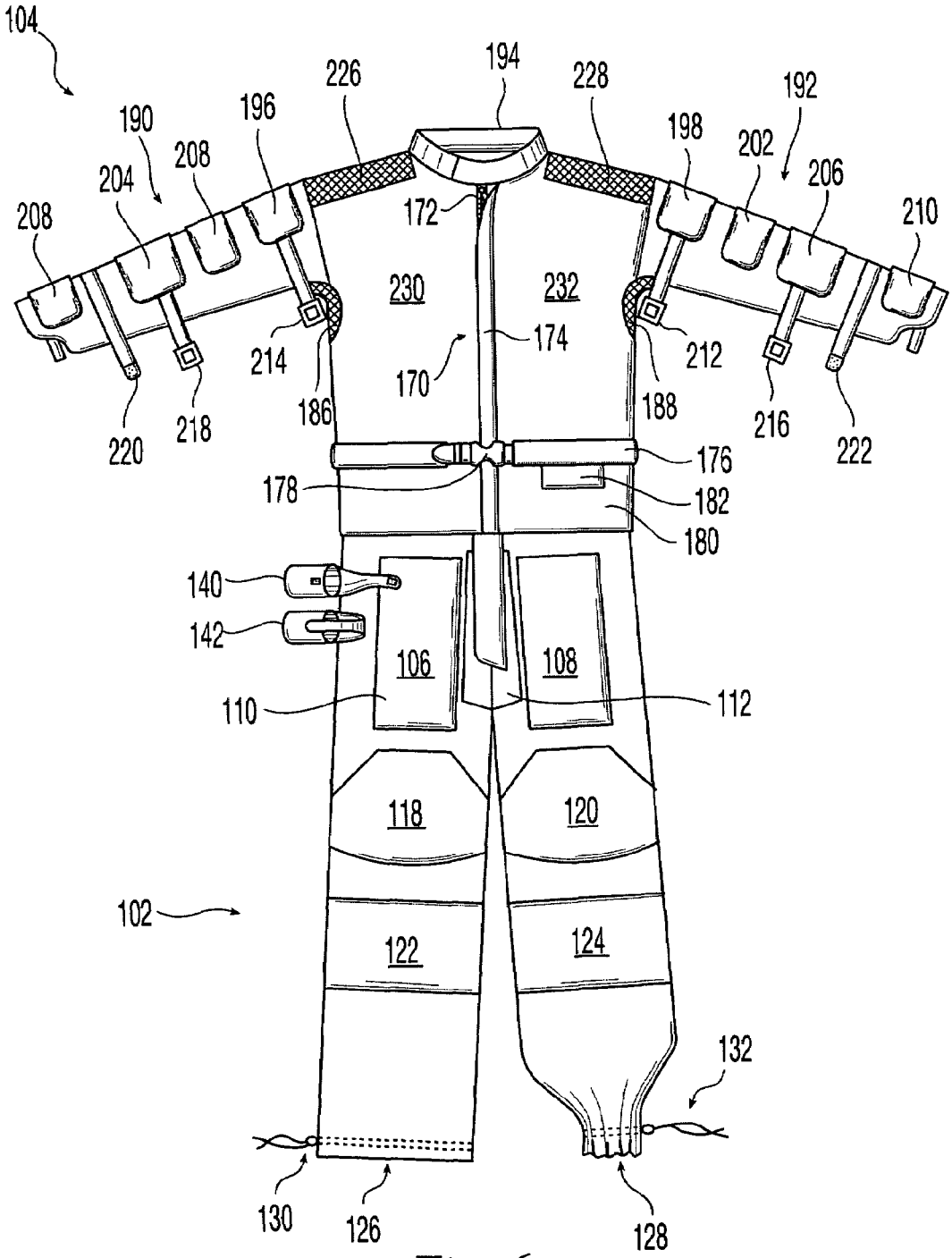
FIG. 6 is a front view of a second embodiment of an upper portion of a protective garment according to the present invention and is illustrated with the lower portion of FIG. 6.

Another embodiment of a protective garment 100 is illustrated in FIGS. 5 and 6. The protective garment 100 has a lower portion 102 and an upper portion 104 that cooperatively protect the wearer in sporting games, particularly those that include projectiles. The lower portion 102, illustrated in FIG. 5 alone to show the detail, is similar to lower torso portion 19 illustrated above except that it is separated from the upper portion 104. Additionally, the lower portion 102 has modified padding from lower torso portion 19. The lower portion 102 preferably has two thigh pads 106,108 positioned to protect the wearer's thigh area. The lower portion 102 also has two crotch pads 110,112 that surround the closure 114 for the lower portion 102. The closure 114 in the present embodiment is a zipper (not shown in FIG. 5) hidden by a padded cover. However, the closure 114 could be any appropriate closure, including snaps, buttons and holes, hook-and-loop, etc. The lower portion 102 preferably has a belt 116 as in the previous embodiment to hold the lower portion 102 around the wearer's waist.

The lower portion 102 also preferably has knee pads 118,120 to protect the wearer's knees, with shin pads 122,124 to protect the wearer's shins. At the bottom of each leg 126,128 are securing members 130,132 to snugly hold the legs of the lower portion 102 against the wearer and prevent them from catching on brush, bushes, etc. As depicted in FIGS. 5-9, the securing members are drawing strings 134 with stopper closures 136,138, but could be of any type, including typical buckles, hook-and-loop type closures, snap closures, etc. The lower portion 102 also has two holders 140,142 that are preferably sewn into a side seam. The holders 140,142 have a cover strap 144,146 that attaches to the outside of a respective holder to secure the contents, typically additional ammunition such as paint balls, inside the holders.

The lower portion 102 also has a belt pad 148 along the back portion to protect the wearer's kidneys and to make the lower portion 102 more comfortable while being worn. A top portion the pad 148 can be seen in FIG. 5, in phantom in FIG. 7, and in the alternative embodiment in FIG. 8. The lower portion 102 also preferably has seat padding 150,152 to protect at least a portion of the waist area of the wearer. See FIG. 7. Also it is preferable to have back thigh pads 154,156 to protect the back of the legs of the wearer. The thigh area 158 also includes securing members 160,162, which illustrate the use of safety closures and straps (as discussed above), but could be any of the closures previously discussed. The lower portion also has a squeegee holder 54',59' as in the first embodiment.

Figure 7:
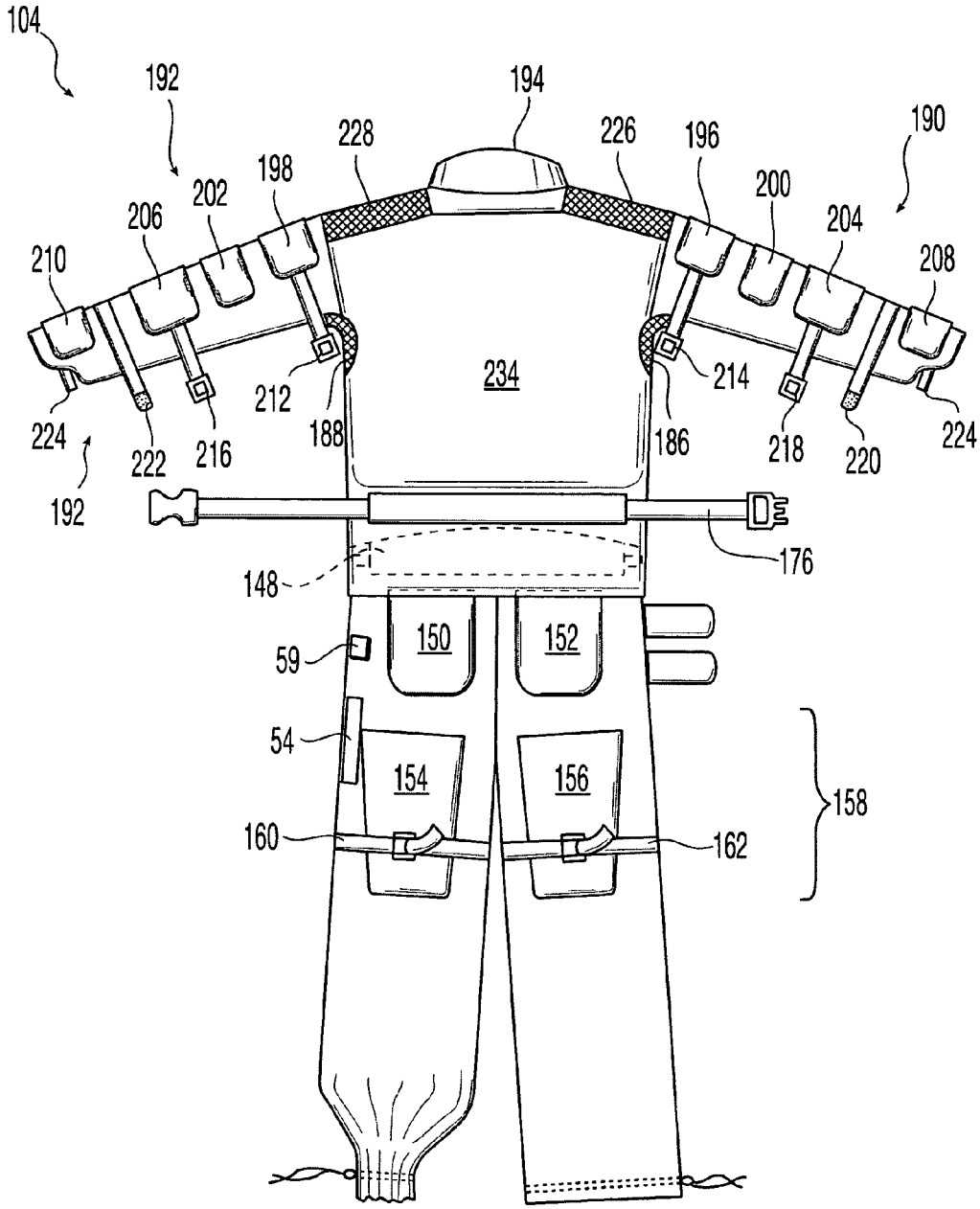
FIG. 7 is a rear view of the protective garment of FIG. 6.

The top portion 104 has padding in similar places as in the first embodiment, but has more variety and a different closure in the embodiment illustrated in FIGS. 6 & 7. The top portion 104 covers a majority of the wearer's torso and arms, and has front closure 170, that is illustrated as a zipper 172, but could be any appropriate closure, including snaps, buttons and holes, hook-and-loop, etc. The cover 174 is, as with the cover for the closure 114 for the lower portion 102, is preferably padded for extra protection. The top portion 104 also has a belt 176 with a securing member 178, illustrated as a safety closure, to keep the top portion 104 securely fastened about the wearer. A pocket 180 may also be included, the pocket may have a flap closure 182.

Ventilation areas 186,188 are provided under the arm portions 190, 192. The ventilation areas are preferably a webbed or mesh material to allow body heat to escape during use. It is also contemplated that the ventilation areas 186,188 not have any material at all, but simply be holes.

A padded collar 194 is also provided to provide protection to the wearer's neck area. The padded collar 194 has an opening similar to that shown in FIG. 4. Other padded areas on the arm portions 190, 192 include the bicep/tricep area, which has bicep pads 196,198, the elbow area with elbow pads 200,202, and the forearm area with forearm pads 204,206. Preferably, each of the arm portions 190, 192 also include wrist pads 208,210. The arm portions 190, 192 preferably have a plurality of securing elements. These include securing elements that may be elastic straps or non-elastic straps with a closure at the ends, which may be a safety closure or hook-and-loop materials. For example, the bicep and forearm securing elements 212,214,216,218 are preferably non-elastic straps with a safety closure on each. The wrist securing elements 220,222 are preferably elastic straps with hook-and-loop material. The ends of the arm portions 190,192 preferably have an elastic strap 224 through which the wearer inserts a hand or a portion of a hand to secure the wrist/hand pad 208,210 to the wearer.

The upper portion also has two shoulder pads 226,228, which are illustrated as being quilted. In fact, all of the pads may have quilting, which need not be for function, but only for appearance.

The upper portion 104 preferably has two large pads 230,232 to cover the chest area of the wearer as shown in FIG. 6. As can be seen in FIG. 7, the upper portion 104 also has a large back pad 234 to cover the wearer's back. The large back pad 234 preferably ends just above the belt 176, but may extend downward beyond the belt to provide more protection. As illustrated in dotted lines in FIG. 7, the belt pad 148 from the lower portion 102 extends upward to provide protection from underneath the upper portion 104.

Figure 8:
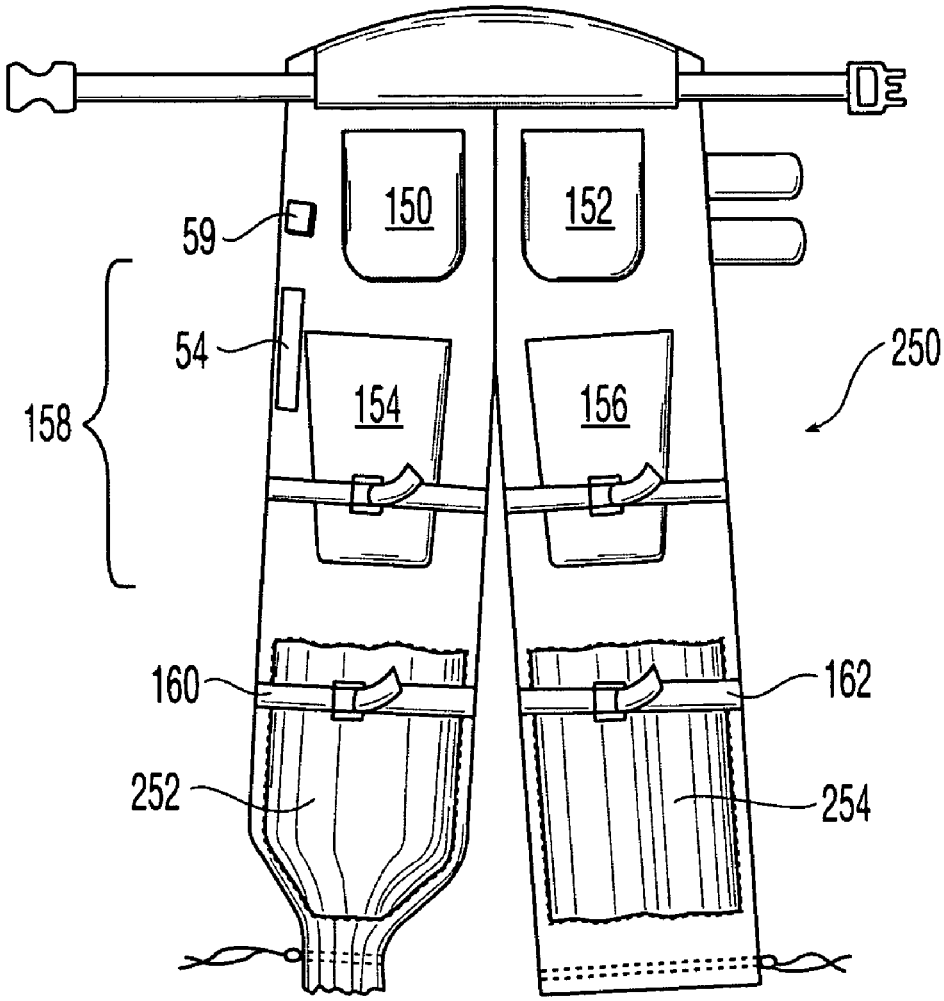
FIG. 8 is a rear view of another embodiment of a lower portion of a protective garment according to the present invention.

An alternative lower portion 250 is illustrated in FIG. 8. Lower portion 250 is similar to lower portion 102 except that lower portion 250 has two openings 252,254 in the calf area of the wearer. The openings 252,254 allow body heat to escape and provide ventilation to the lower portion 250. Such openings may be used in other areas of the protective garment, as long as the function of the protective pads are not affected. For example, the there could be openings under the arms on portions 190,192 or between the ventilation areas 186,188 and the belt 176. The lower portion may also have a squeegee holder 54',59' as in the first embodiment.

Figure 9:
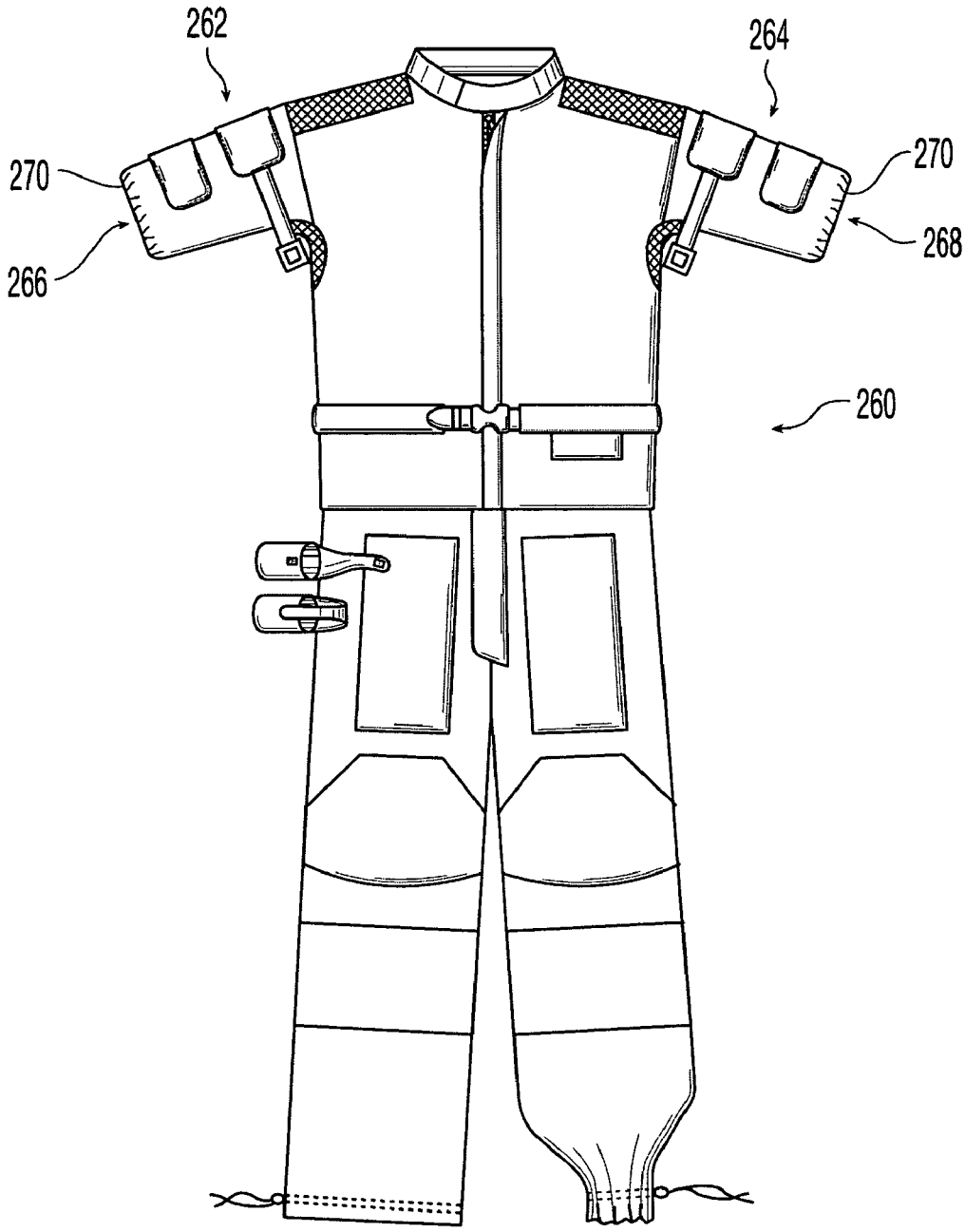
FIG. 9 is front view of another embodiment of an upper portion of a protective garment according to the present invention.

Another embodiment of a protective garment is illustrated in FIG. 9. In this embodiment, the upper portion 260 has short sleeves 262,264 and at the arm openings 266,268 has elastic 270 to keep the arm openings 266,268 close to the wearer and prevent them from being snagged during use. The upper portion 260 has the same padding as upper portion 104, but does not have the forearm pads or the wrist/hand pads. The shorter sleeves make the garment 260 much cooler to wear.

Figure 10:
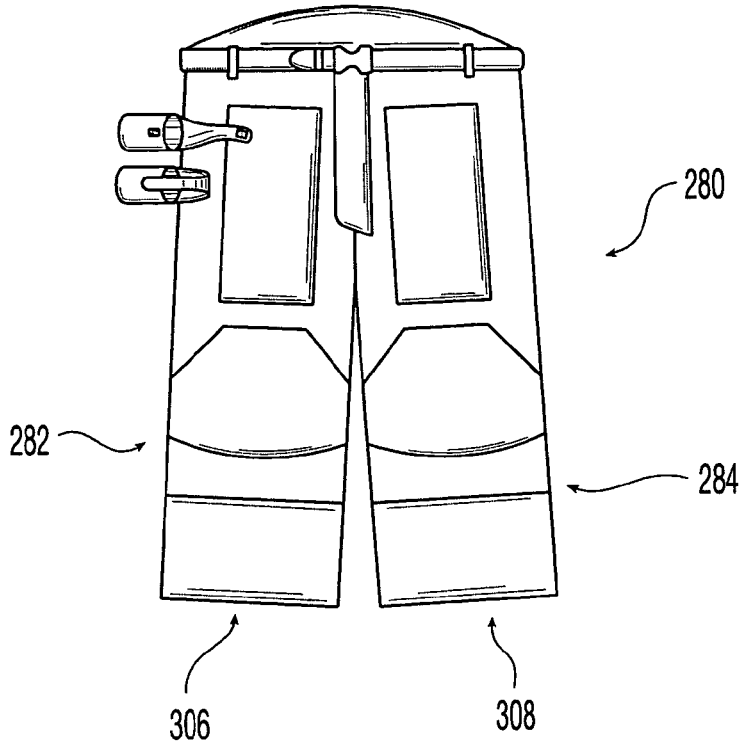
FIG. 10 is a front view of another embodiment of a lower portion of a protective garment according to the present invention.
Figure 11:
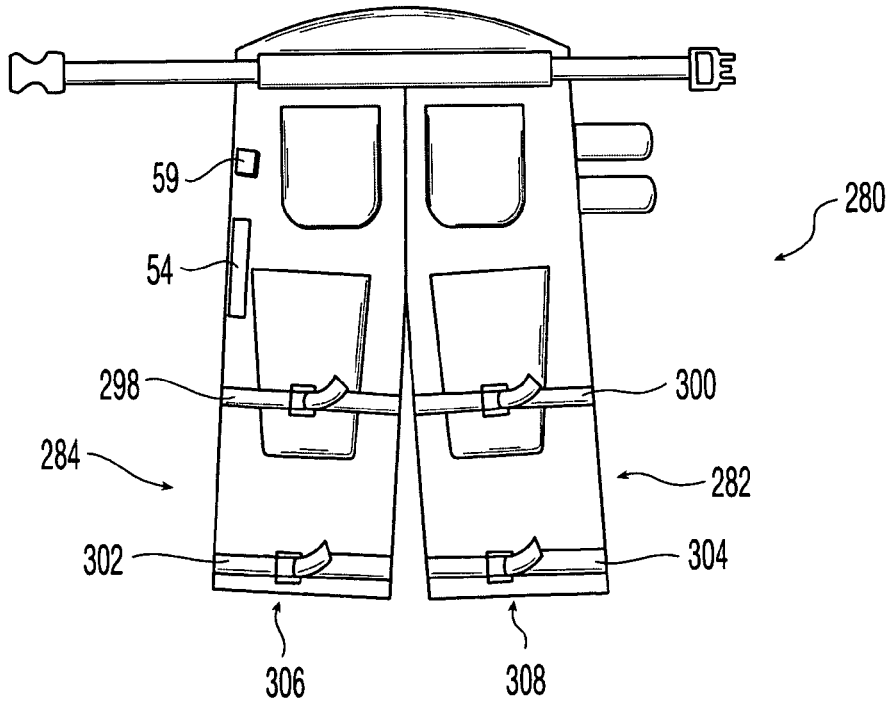
FIG. 11 is a rear view of the lower portion of the protective garment in FIG. 10.

Similarly, an alternative lower portion 280 is illustrated in FIGS. 10 and 11. The lower portion 280 has shorter leg portions 282 and 284 than in the above embodiments, thereby making this lower portion 280 cooler for the wearer without sacrificing the function. The padding in lower portion 280 is similar to that in the lower portions 102,250. That is, there are preferably thigh pads 286,288, knee pads 290,292, and shin pads 294,296. The lower portion 280 also preferably has securing elements 298,300,302,304 as above, but any of the securing elements may be eliminated depending on the use of the garment. Moreover, the openings 306,308 may also have elastic (not shown) as with the arm openings 262,264 in the upper portion 260.

Figure 12:
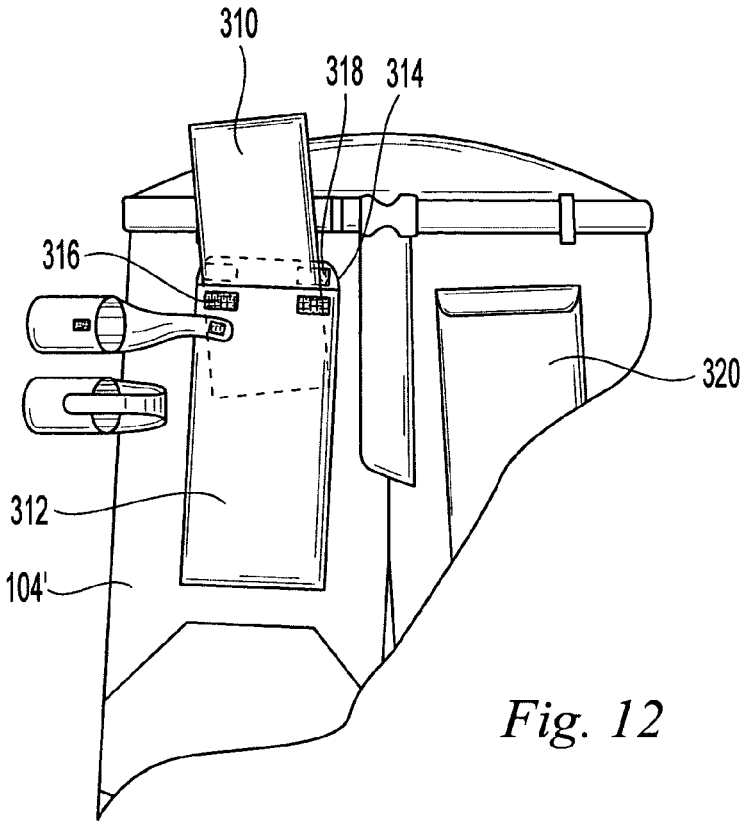
FIG. 12 illustrates a pocket closure.

It should also be noted that while the pads in the figures are illustrated as being sewn into the garments, the pads may be removable. For example, as shown in FIG. 12, the pad 310 may be inserted into a pocket 312 or other opening at the appropriate location. In the portion of the lower portion 104' illustrated in FIG. 12, the pad 310 is illustrated as being inserted into a pocket 312. Pocket 312 preferably has a flap 314 that has at least one closure to secure the pad 310 into it. The closure illustrated in FIG. 12 includes a hook-and-loop fastener, with the loop portion 316 on the pocket and the hook portion 318 on the flap 314, although they could be reversed. Other types of closures for the pockets, such as buttons, snaps, zippers, etc. are within the scope of the present application. The pocket 320 is illustrated as being closed.

Figure 13:
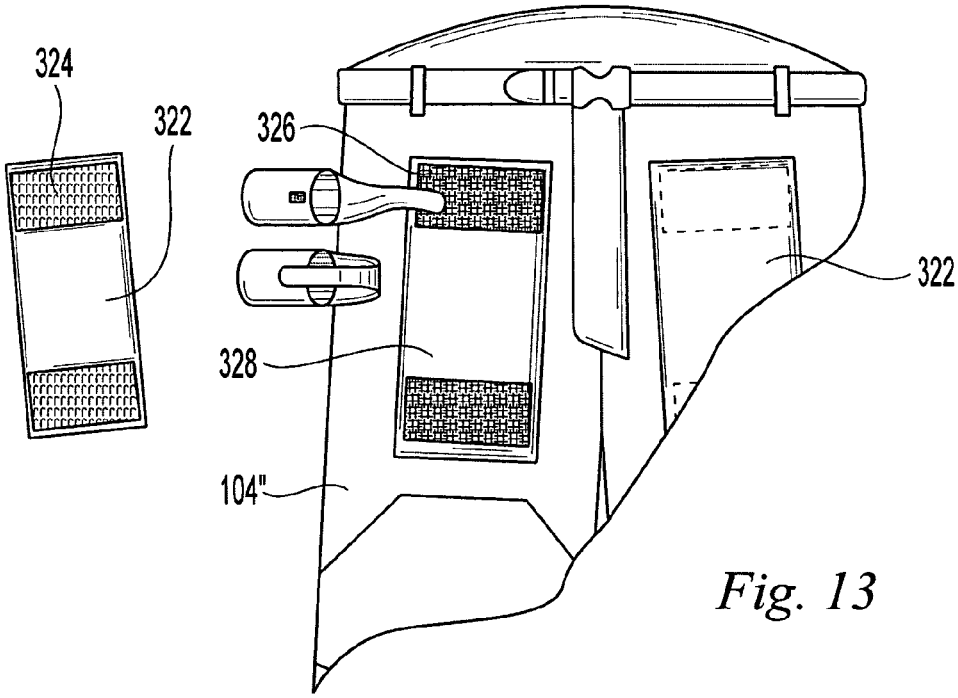
FIG. 13 shows an alterative pad attachment.

Alternatively, the pads 322 may be attached to protective garments with a hook-and-loop fastener. Such an embodiment is illustrated in FIG. 13. The pads 322 have the hook portion 324 of the hook-and-loop fastener, while the garment (a portion of a lower portion 104" is used for illustrative purposes in the figure) has the loop portion 326 and the pads 322 can be attached as required by the wearer. Obviously, the hook and loop portions could be reversed in their application, but if the hook portion is on the garment and a pad is not used, the hook portion of the material may pick up debris during use, requiring the wearer to clean out the debris before a pad will adhere to the hook material in the future. The lower portion 104" may also have an area 328 to which the pads 322 and the hook and loop portions 324,326 are attached, or they may be attached directly to the lower portion 104".

It will be apparent to those skilled in the art that various modifications and variations can be made in the multi-fiber ferrule of the present invention without departing from the spirit or scope of the invention. Thus, it is intended that the present invention cover the modifications and variations of this invention provided they come within the scope of the appended claims and their equivalents.

I claim:

1. A protective garment for use in sporting games, the protective garment comprising:

an upper portion for covering at least a portion of a wearer's arms and torso;

a lower portion for covering at least a portion of the wearer's waist area and legs;

a plurality of pads connected to the protective garment to protect the wearer during the sporting game, the pads protecting chest, back, knee, elbow, and crotch areas of the wearer;

at least two ventilation areas, the at least two ventilation areas each comprising an opening in the upper portion and disposed in an area corresponding to the armpits of the wearer and having a mesh covering; and a plurality of securing members to secure the protective garment at a plurality of locations on the wearer, the securing members attached to the protective garment at at least the arms, ankles, and knees.

2. The protective garment according to claim 1, wherein the upper portion of the protective garment covers a majority of the wearer's arms and torso.

3. The protective garment according to claim 1, wherein the lower portion of the protective garment covers a majority of the wearer's waist area and legs.

4. The protective garment according to claim 1, wherein the at least two ventilation areas comprises at least three ventilation areas and includes a ventilation area on at least a portion of the upper portion corresponding to the torso.

5. The protective garment according to claim 1, further comprising at least one elastic member to secure at least a portion of the protective garment to the wearer.

6. The protective garment according to claim 1, the upper portion further comprising:

a covering on a front side of the protection garment having an increased thickness for protection.

7. The protective garment according to claim 6, wherein the covering is located over a ventilation area a on the upper portion corresponding to the torso.

8. The protective garment according to claim 1, further comprising a plurality of loop devices for storing accessories to be used during the sporting games.

9. The protective garment according to claim 1, wherein the upper portion has a sealable opening extending from an opening in the upper portion for the wearer's neck to the lower portion for access to the protective garment.

10. The protective garment according to claim 9, wherein the scalable opening is opened and closed with a zipper.

11. The protective garment according to claim 1, wherein at least a portion of the garment is comprised of a water resistant material.

12. The protective garment according to claim 1, wherein the upper portion and the lower portion are two separate portions.

13. The protective garment according to claim 12, wherein at least a portion of the upper portion covers at least a portion of the lower portion of the protective garment.

14. The protective garment according to claim 12, wherein the lower portion covers a portion of the wearer corresponding to a thigh area.

15. The protective garment according to claim 1, further comprising a protective pad in the upper portion to protect the wearer's neck.

16. The protective garment according to claim 1, wherein the pads are removable from the garment.

17. The protective garment according to claim 1, further comprising a pad to cover at least a. portion of the wearer's hand.

18. The protective garment according to claim 1, wherein the upper portion has short sleeves.

* * * * *